US009908764B2

(12) United States Patent
Elliott

(10) Patent No.: US 9,908,764 B2
(45) Date of Patent: Mar. 6, 2018

(54) HANDHELD CONTROL UNIT FOR AUTOMOTIVE LIFT

(71) Applicant: VEHICLE SERVICE GROUP, LLC, Madison, IN (US)

(72) Inventor: Robert W. Elliott, Madison, IN (US)

(73) Assignee: Vehicle Service Group, LLC, Madison, IN (US)

( * ) Notice: Subject to any disclaimer, the term of this patent is extended or adjusted under 35 U.S.C. 154(b) by 984 days.

(21) Appl. No.: 14/202,328

(22) Filed: Mar. 10, 2014

(65) Prior Publication Data

US 2014/0264203 A1 Sep. 18, 2014

Related U.S. Application Data

(60) Provisional application No. 61/783,408, filed on Mar. 14, 2013.

(51) Int. Cl.
*B66F 7/10* (2006.01)
*B66F 13/00* (2006.01)
(Continued)

(52) U.S. Cl.
CPC ..... *B66F 13/00* (2013.01); *B66F 3/46* (2013.01); *B66F 7/28* (2013.01)

(58) Field of Classification Search
CPC ..... B66F 13/00; B66F 3/46; B66F 7/28
(Continued)

(56) References Cited

U.S. PATENT DOCUMENTS 2,979,581 A * 4/1961 Ballou ..... H01H 9/0214 200/43.13
4,531,614 A * 7/1985 Naegeli ..... B66F 7/04 187/208
(Continued)

FOREIGN PATENT DOCUMENTS

EP 1 655 593 A2 5/2006
EP 2 316 778 5/2011
(Continued)

OTHER PUBLICATIONS

Partial European Search Report dated May 16, 2014 for Application No. EP 14 00 0887.
(Continued)

*Primary Examiner* — Anthony Salata
(74) *Attorney, Agent, or Firm* — Frost Brown Todd LLC

(57) ABSTRACT

An apparatus for operating a vehicle lift comprises at least one lifting assembly, a control unit, and a control pendant. The control pendant is configured to remotely control the motion of the vehicle lift through the control unit. The control pendant is configured to permit the lifting of a vehicle by the push of a single button on the control pendant. To permit lifting of a vehicle with a single button, the control pendant comprises a menu screen and a plurality of menu buttons. The menu screen and the plurality of menu buttons may be used together by a user to select one vehicle profile of a plurality of vehicle profiles. The selected vehicle profile may correspond to the vehicle being lifted. The selected vehicle profile provides specific data with respect to how the at least one lifting assembly should be moved for the particular vehicle being lifted.

14 Claims, 10 Drawing Sheets

(51) Int. Cl.
*B66F 7/28* (2006.01)
*B66F 3/46* (2006.01)

(58) Field of Classification Search
USPC ..... 187/203, 206, 207, 209, 210, 223, 277, 187/391, 211, 219, 220
See application file for complete search history.

(56) References Cited

U.S. PATENT DOCUMENTS 4,789,135 A * 12/1988 Watanabe ..... B66C 13/56 200/298
5,671,567 A * 9/1997 Silberman ..... B64F 1/22 187/205
6,498,959 B1 * 12/2002 January ..... G01B 11/00 33/227
6,963,037 B1 * 11/2005 Bennett ..... B66C 13/40 200/43.16
6,983,196 B2 1/2006 Green et al.
6,994,223 B1 * 2/2006 Edgar, II ..... B66C 23/905 212/270
7,146,701 B2 * 12/2006 Mahoney ..... H01H 13/70 200/512
7,191,038 B2 * 3/2007 Green ..... B66F 7/04 254/45
7,251,552 B2 * 7/2007 Schmeisser ..... G06F 1/1609 340/438
7,272,476 B2 * 9/2007 Ortiz ..... B60R 16/0234 701/29.1
8,083,034 B2 12/2011 Bordwell et al.
8,301,334 B2 * 10/2012 Knapp ..... G01M 17/06 340/539.11
8,381,409 B2 * 2/2013 Knoke ..... G01B 11/03 33/228
9,352,944 B2 * 5/2016 Fagan ..... B66F 3/46
9,376,296 B2 * 6/2016 Nussbaum ..... B66F 7/20
2002/0175319 A1 11/2002 Green et al.
2004/0149520 A1 8/2004 Taylor et al.
2005/0045429 A1 3/2005 Baker
2005/0182522 A1 8/2005 Chase
2007/0130522 A1 * 6/2007 Mansell ..... G06F 3/0482 715/744
2009/0236183 A1 9/2009 Bordwell et al.
2010/0096819 A1 4/2010 Flynn et al.
2013/0240300 A1 † 9/2013 Fagan
2016/0275729 A1 * 9/2016 Jaipaul ..... G07C 5/08

FOREIGN PATENT DOCUMENTS

GB 1 045 154 A 10/1966
JP H05 213588 8/1993
KR 2008 0096156 A 5/2006
KR 100 775 939 11/2007
WO WO 2004/026754 5/2011

OTHER PUBLICATIONS

Abstract and English Machine Translation of European Patent EP 2 316 778.
Abstract and English Machine Translation of Japanese Patent JP H05 213588.
Abstract and English Machine Translation of Korean Patent KR 100 775 939.
European Search Report dated May 16, 2014 for Application No. EP 14000887.
European Communication dated Jan. 31, 2017 for Application No. EP 15001253.2, 8 pgs.
U.S. Appl. No. 61/697,406, filed Sep. 6, 2012, inventor John E. Fagan.†
U.S. Appl. No. 61/612,795, filed Mar. 19, 2012, inventor John E. Fagan.†

* cited by examiner
† cited by third party

HANDHELD CONTROL UNIT FOR AUTOMOTIVE LIFT

PRIORITY

This application claims priority to U.S. Provisional Patent Application Ser. No. 61/783,408, entitled "Handheld Control Unit for Automotive Lift," filed Mar. 14, 2013, the disclosure of which is incorporated by reference herein.

BACKGROUND

A vehicle lift is a device operable to lift a vehicle such as a car, truck, bus, etc. Some vehicle lifts operate by positioning superstructures under a vehicle. Thereafter, the superstructures may be raised or lowered to bring the vehicle to a desired height. Afterward, the vehicle may then be lowered once the user has completed his or her task requiring the vehicle lift. In some cases, the controls for the vehicle lift may be affixed to a portion of the vehicle lift, such as a lift column. In some other cases, the controls for the vehicle lift may be located in some other structure that is secured to the floor, such as a control cabinet. By locating the controls in such a fixed location, it may be difficult for the operator to easily view certain portions of the lift and/or vehicle while operating the controls. For instance, it may be difficult for the operator to determine proper positioning of superstructures under the vehicle while simultaneously controlling the vehicle lift.

Further examples of such vehicle lift devices and related concepts are disclosed in U.S. Pat. No. 6,983,196, entitled "Electronically Controlled Vehicle Lift and Vehicle Service System," issued Jan. 3, 2006, the disclosure of which is incorporated by reference herein; U.S. Pat. No. 7,191,038, entitled "Electronically Controlled Vehicle Lift and Vehicle Service System," issued Mar. 13, 2007, the disclosure of which is incorporated by reference herein; U.S. Pat. No. 8,083,034, entitled "Lift Control Interface," issued Dec. 27, 2011, the disclosure of which is incorporated by reference herein; and U.S. Pub. No. 2004/0149520, entitled "Inground Lift," published Aug. 5, 2004, the disclosure of which is incorporated by reference herein.

While a variety of vehicle lifts have been made and used, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
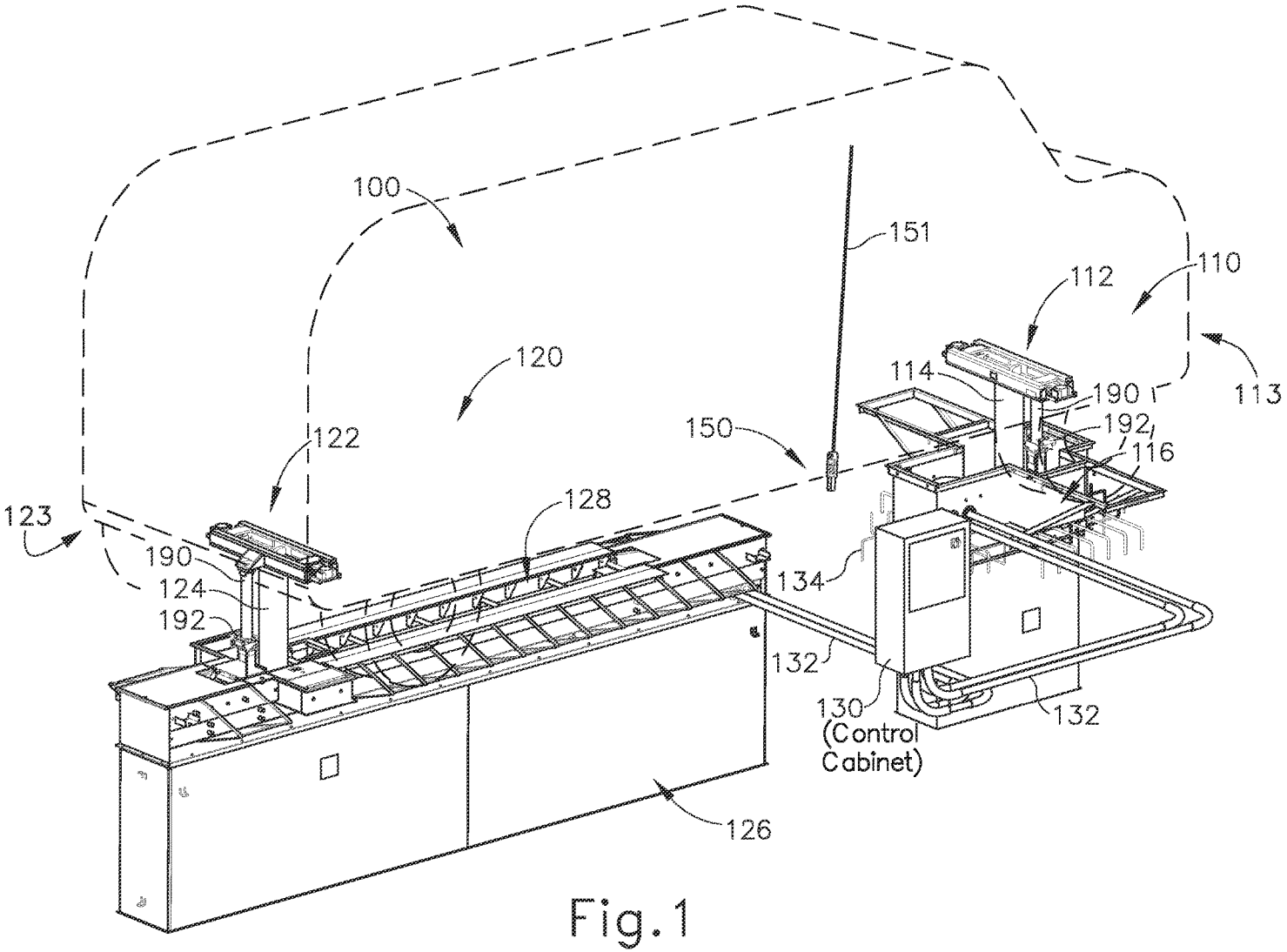
FIG. 1 depicts a perspective view of a vehicle lift system with an exemplary pendant control.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

FIG. 1 shows an exemplary vehicle lift system (100) comprising a first lift assembly (110), a second lift assembly (120), and a control cabinet (130). Vehicle lift system (100) is operable to control lift assemblies (110, 120) to lift respective portions (113, 123) of a vehicle in response to control signals sent by control cabinet (130). Although control cabinet (130) is depicted as a cabinet, it should be understood that control cabinet (130) may take any suitable form and/or may be integrated into other parts of the vehicle lift system (100). First lift assembly (110) comprises a superstructure (112) mounted to a post (114) that reciprocates vertically relative to an inground portion (116). Similarly, second lift assembly (120) comprises a superstructure (122) mounted to a post (124) that reciprocates vertically relative to an inground portion (126). Superstructures (112, 122) are configured to engage a vehicle and thereby raise and lower the vehicle relative to the ground as posts (114, 124) are raised and lowered relative to inground portions (116, 126). By way of example only, posts (114, 124) and superstructures (112, 122) may be raised and lowered relative to inground portions (120, 122) using hydraulics, screw mechanisms, scissor mechanisms, and/or any other suitable kind of lifting technology. Lift superstructures (110, 112) may engage vehicles in numerous ways, such as by contacting the chassis of a vehicle, the axles of a vehicle, the wheels of a vehicle, and/or any other suitable lift points on a vehicle. In the present example, inground portion (126) also includes a longitudinal path (128) and a drive feature (not shown) that is operable to translate post (124) and superstructure (122) at selected locations along longitudinal path (128). This enables vehicle lift system (100) to accommodate vehicles of various lengths, by selectively positioning superstructure (122) under the appropriate lift point for the particular vehicle to be lifted.

As noted above, control cabinet (130) is operable to control vehicle lift system (100). This may include selectively raising and lowering posts (114, 124) and superstructures (112, 122), translating post (124) and superstructure (122) along longitudinal path (128), halting movement of posts (114, 124) and superstructures (112, 122), etc. Control cabinet (130) may be equipped with one or more control boards, PCBs, a computer, microprocessor, and/or any other suitable components configured to transmit, store, carry out, etc. instructions to operate vehicle lift system (100). In the present example, control cabinet (130) is in communication with lift assemblies (110, 120) via conduits (132), which may include wires, hydraulic lines, etc. It will be appreciated that other suitable methods of communication may be used. For instance, control cabinet (130) and lift assemblies (110, 120) may be equipped with wireless receivers and transmitters (134) operable to establish wireless communication between control cabinet (130) and lift assemblies (110, 120). Other suitable methods of communication may be used as would be apparent to one of ordinary skill in the art in view of the teachings herein. While vehicle lift system (100) of the present example comprises a two-post in-ground lift, it should be understood that the teachings herein may be readily applied to various other kinds of vehicle lifts, including but not limited to in-ground scissor lifts, above ground lifts, and many other kinds of lifts as will be apparent to those of ordinary skill in the art.

A pendant control (150) is connected to a pendant cable (151). Pendant cable (151) may be routed through a wall, ceiling, etc. to connect to control cabinet (130). Pendant cable (151) in some instances may comprise a serial cable, but it will be understood that pendant cable (151) may include any suitable form of wired communication as would be apparent to one of ordinary skill in the art in view of the teachings herein. While in the exemplary version pendant control (150) is in communication with control cabinet (130) through pendant cable (151), it will be understood that pendant cable (151) need not be used. For instance, pendant control (150) and control cabinet (130) may be equipped with transceivers configured to wirelessly communicate information to each other. Pendant control (150) is operable to provide instructions to control cabinet (130) regarding operation of lift assemblies (110, 120). In some versions, pendant control (150) communicates directly with lift assemblies (110, 120), such that control cabinet (130) may be omitted (at least in part).

Figure 2:
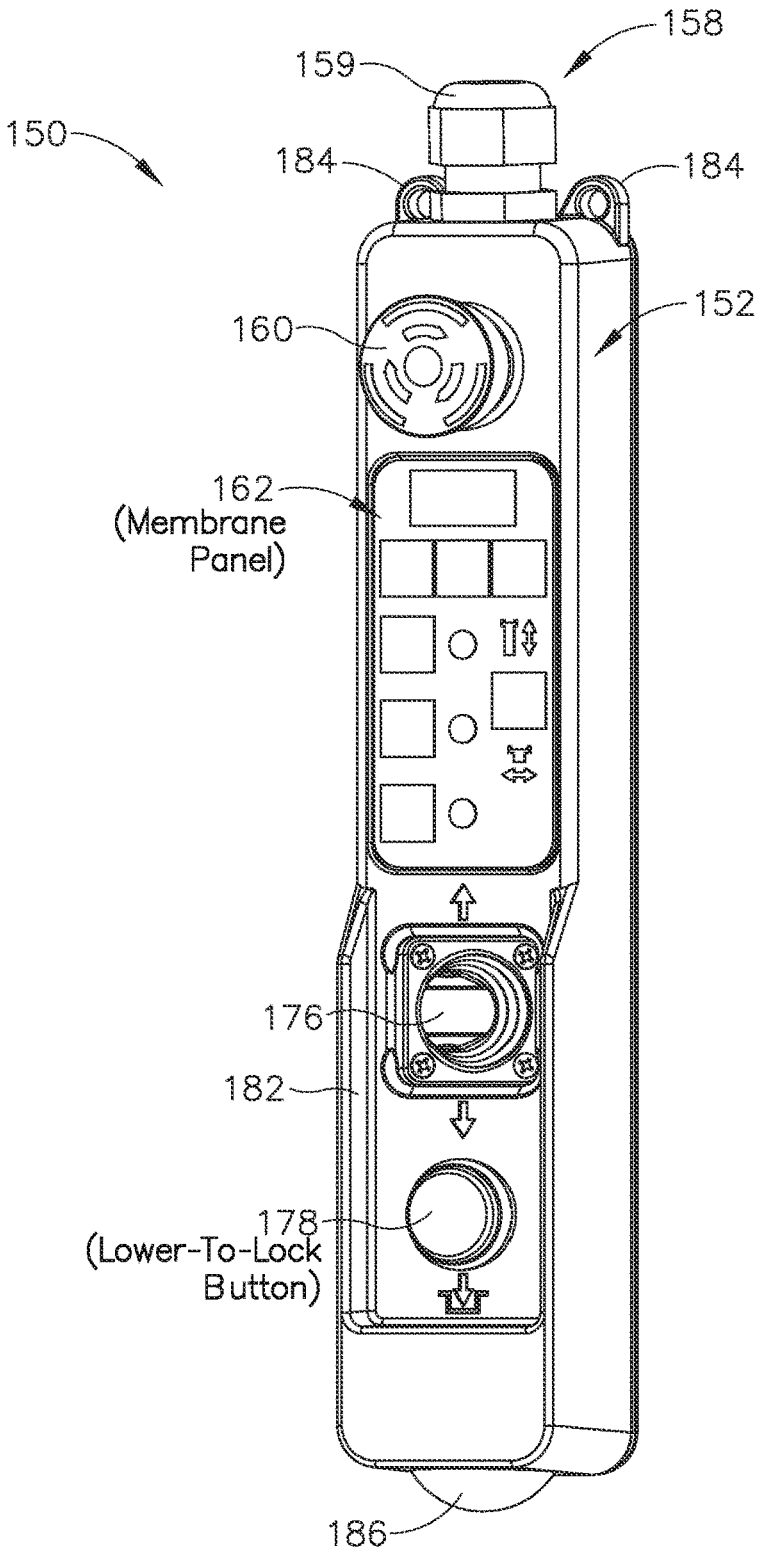
FIG. 2 depicts a front, perspective view of the pendant control of the system of FIG. 1.
Figure 3:
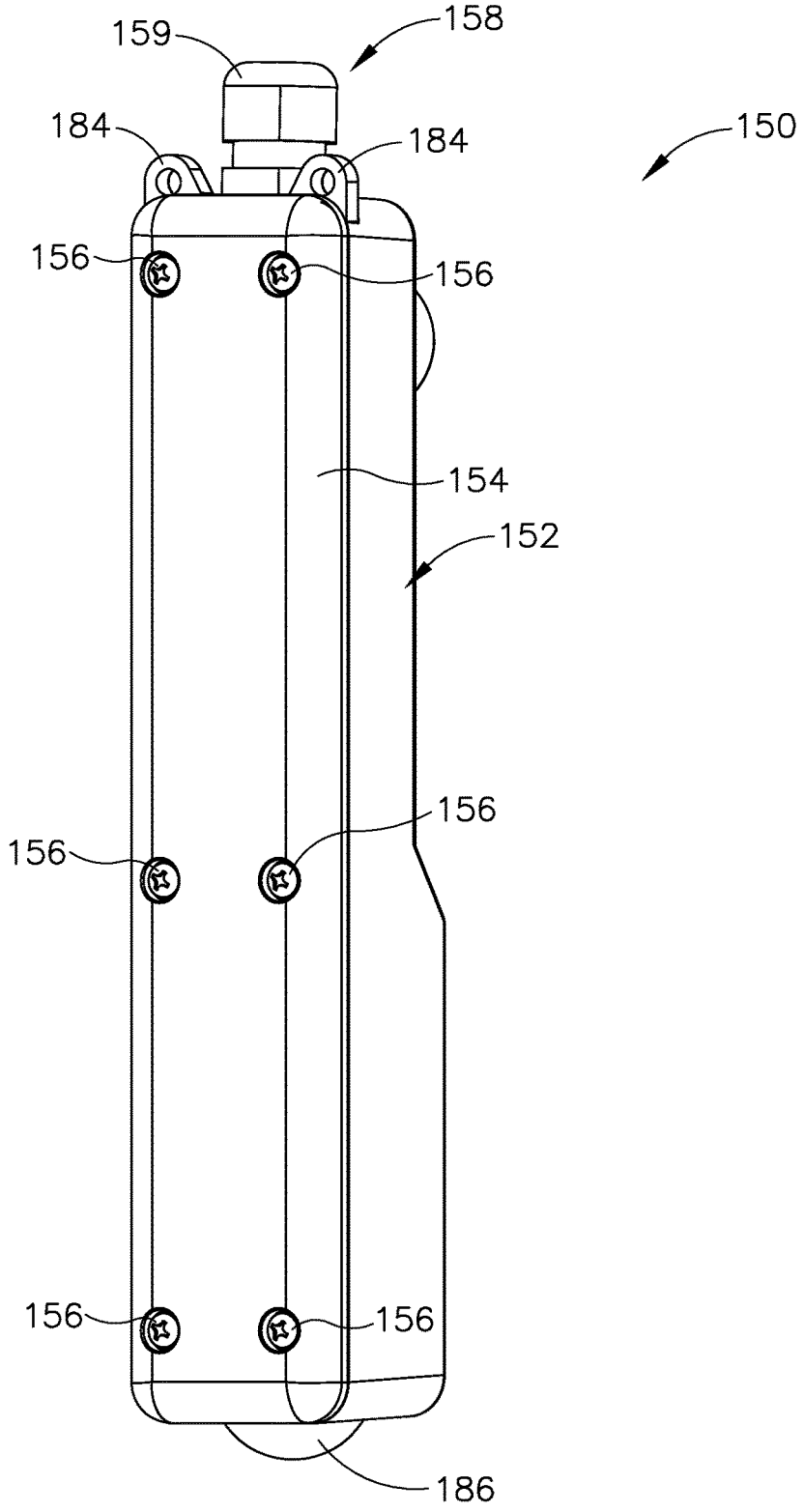
FIG. 3 depicts a rear, perspective view of the pendant control of FIG. 2.
Figure 4:
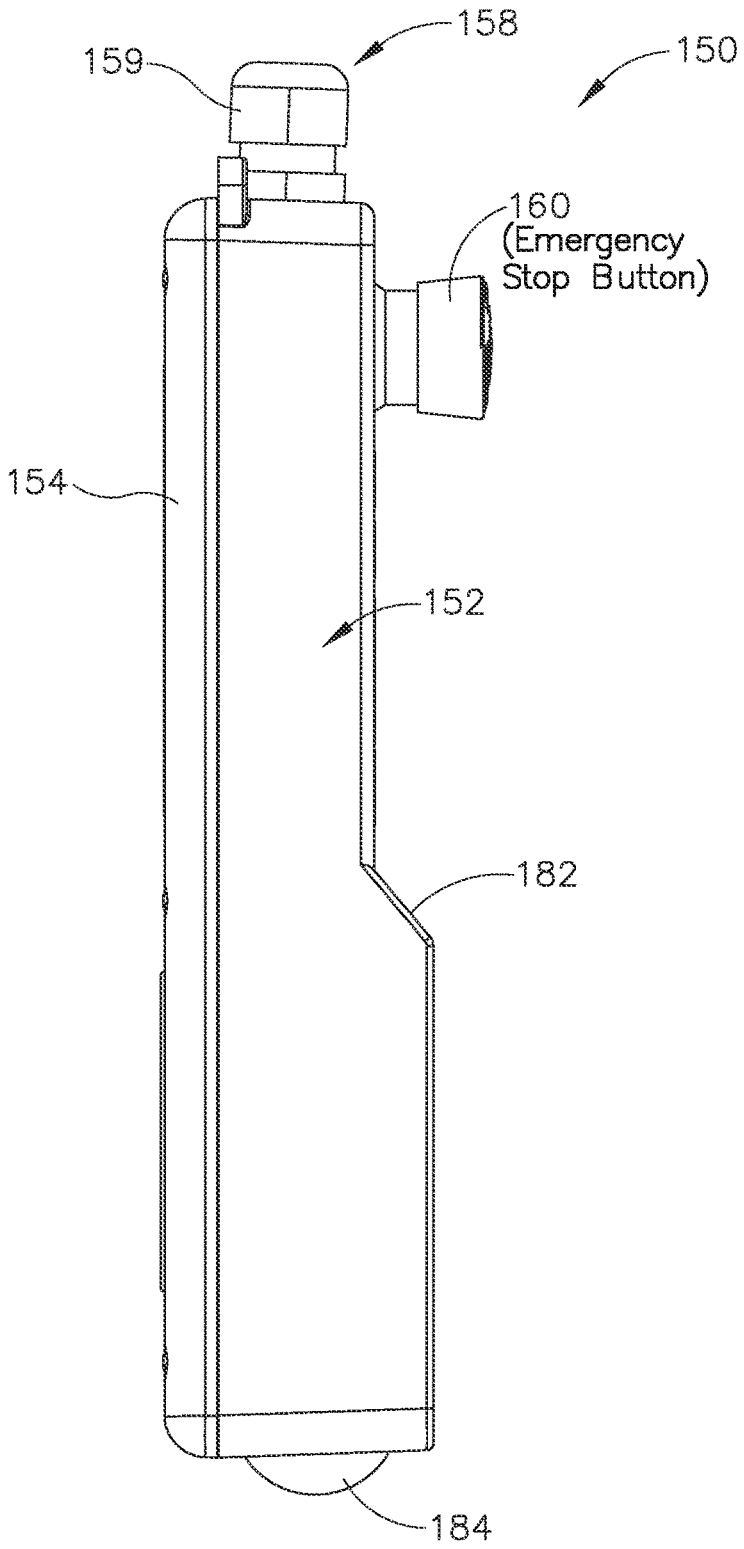
FIG. 4 depicts a side, elevation view of the pendant control of FIG. 2.
Figure 5:
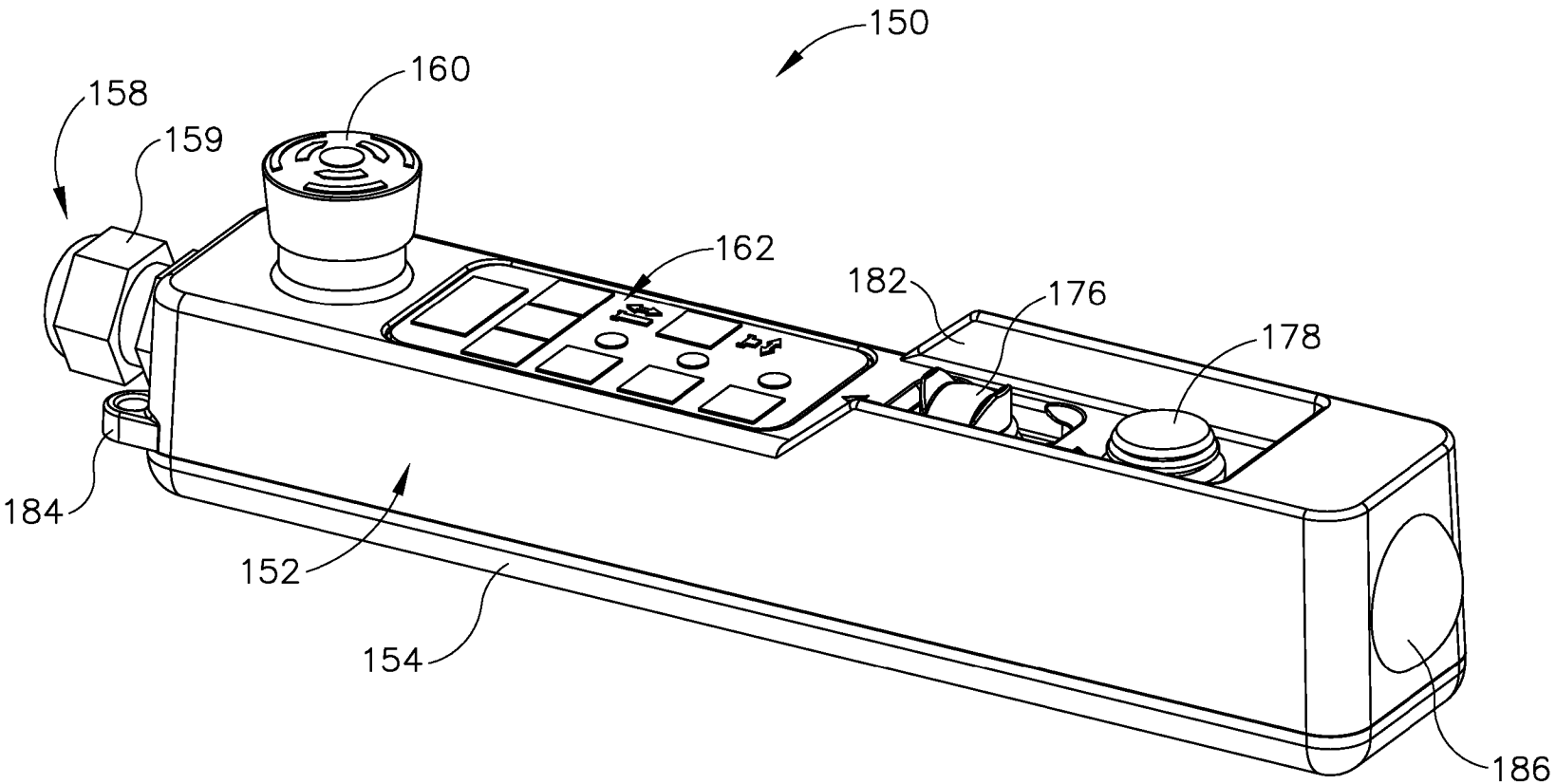
FIG. 5 depicts a side, perspective view of the pendant control of FIG. 2.

FIGS. 2-5 show an exemplary pendant control (150) operable for use with vehicle lift system (100). Pendant control (150) comprises a housing (152), a cord grip (158), an emergency stop button (160), a membrane panel (162), a lift rocker joystick (176), and a lower to lock button (178). Housing (152) has an elongated rectangle shape, but it will be understood that housing (152) may have any other suitable shape as would be apparent to one of ordinary skill in the art in view of the teachings herein. Housing (152) may be constructed of a durable plastic, rubber, metal, and/or other suitable material(s). Housing (152) includes a back plate (154), as seen in FIG. 3. Back plate (154) may be removed to gain access to internal portions of housing (152). A plurality of screws (156) secure back plate (154) onto housing (152). It will be understood that any suitable fasteners may be used to connect back plate (154) and housing (152). Housing (152) further includes two attachment portions (184) operable to receive a lanyard, string, keyring, or other suitable support structure. Although attachment portions (184) are shown as protruding from housing (152), it should be understood that attachment portions (184) may be of any other suitable design such as being integrated into the structure of housing (152). Housing (152) may also contain any suitable number of attachment portions (184), a single attachment portion (184), or attachment portions (184) may be omitted entirely.

Cord grip (158) has a removable cap (159) operable to tighten cord grip (158). Cord grip (158) is configured to engage pendant cable (151) to establish communication between pendant control (150) and pendant cable (151). It will be understood that cord grip (158) may be in communication with pendant cable (151) through a screw coupling, snap coupling, or any other suitable coupling mechanism. As can best be seen in FIG. 5, housing (152) has a dome cap (186). Dome cap (186) is operable to plug the bottom of housing (152). In some instances, cord grip (158) may be removed and placed in this position. Thus, cord grip (158) and pendant cable (151) may be selectively placed on the top or bottom of housing (152).

Emergency stop button (160) is shaped as a large circular, protruding button. Emergency stop (160) is operable to immediately initiate a stop action to bring posts (114, 124) and superstructures (112, 122) to a controlled stop. It will be understood that other suitable button shapes may be used that allow a user to quickly halt movement within vehicle lift system (100). It will be understood that pressing emergency stop button (160) sends instructions to control cabinet (130), which then commands lift assemblies (110, 120) to halt movement of lift superstructures (110, 112).

Figure 6:
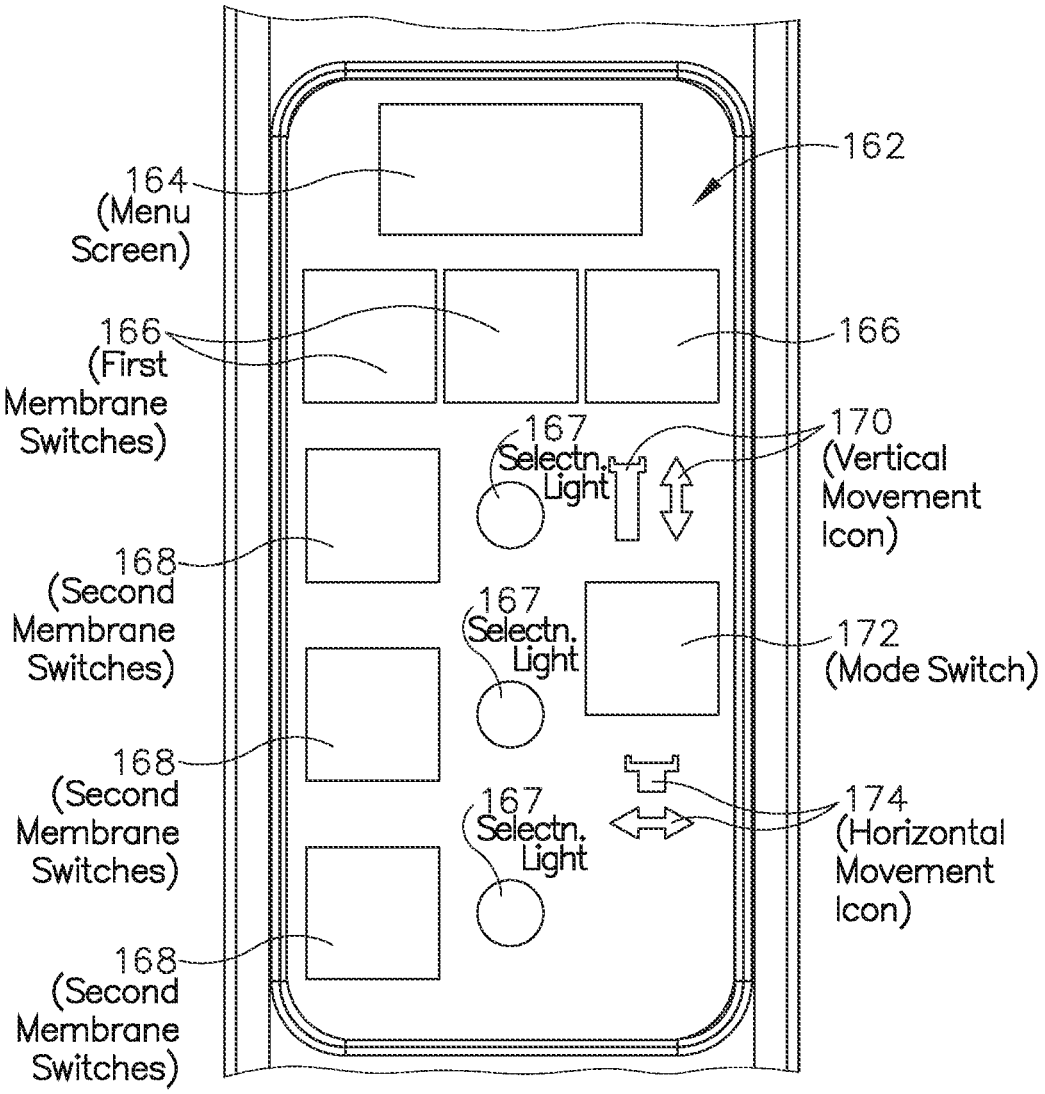
FIG. 6 depicts an enlarged, plan view of a control panel of the pendant control of FIG. 2.

FIG. 6 shows an enlarged view of membrane panel (162). Membrane panel (162) comprises a touchpad membrane, but it will be understood that other suitable constructions for membrane panel (162) may be used as would be apparent to one of ordinary skill in the art in view of the teachings herein. For instance, membrane panel (162) could comprise a face plate and corresponding buttons. Membrane panel (162) comprises a menu screen (164), first membrane switches (166), second membrane switches (168), mode switch (172), vertical movement icon (170), and horizontal movement icon (174). In some versions, all of these features are provided through a printed circuit board that is located behind membrane panel (162). Such a circuit board may also include hardware configured to provide communication with control cabinet (130).

Menu screen (164) may comprise an LCD, LED powered LCD, or any other suitable display. In the exemplary version, a three character, seven segment LED is used for menu screen (164). In some other versions, a single or dual screen display may be used instead. Menu screen (164) is operable to provide information to the user. Such information may include visual confirmation of button presses by the user or actions currently being carried out by vehicle lift system (100). Further information may include status information for vehicle lift system (100), error codes, diagnostic codes, heights of superstructures (112, 122), inch counts, and/or other messages regarding any of the components of vehicle lift system (100). Indeed, any suitable information may be provided by menu screen (164) as would be apparent to one of ordinary skill in the art in view of the teachings herein.

First membrane switches (166) comprise three switches (e.g., thin film switches covered by a membrane) that are horizontally aligned and operable to be pressed by the user. While the exemplary version shows three switches, any other suitable number of switches may be provided. Furthermore, any orientation of buttons for first membrane switches (166) may be used as well. First membrane switches (166) may include an "up," "down," and "enter" button as seen in FIG. 6. It will be appreciated that first membrane switches (166) may be used to navigate menus displayed on menu screen (164). For instance, "up" and "down" may be used to cycle through menu options. "Enter" may be used to select/confirm a menu option. It will be understood that any suitable controls may be used for first membrane switches (166) as would be apparent to one of ordinary skill in the art in view of the teachings herein.

First membrane switches (166) and menu screen (164) may be used together to cycle through and select vehicle profiles. Such vehicle profiles may be stored in pendant control (150), control cabinet (130), and/or any other suitable location(s). Lift system (100) may include stored vehicle profiles for a variety of specific vehicle types (e.g., down to the make/model/year, etc.) and/or for a variety of vehicle categories (e.g., bus, truck, etc.). Such vehicle profiles may include a variety of information that may be used to control or otherwise influence various aspects of lift system (100) operation. By way of example only, vehicle profiles may include information relating to a vehicle's wheelbase dimensions, a vehicle's height, a vehicle's axle configuration, etc. Of course, the vehicle profile need not necessarily include actual values for a vehicle's wheelbase dimensions, a vehicle's height, a vehicle's axle configuration, etc. A vehicle profile may instead include sets of instructions for lift system (100) that are based on a vehicle's wheelbase dimensions, a vehicle's height, a vehicle's axle configuration, etc. Various other kinds of information that may be stored in a vehicle profile will be apparent to those of ordinary skill in the art in view of the teachings herein. Data from the vehicle profile may be displayed on menu screen (164); in addition to displaying information such as status information for vehicle lift system (100), error codes, diagnostic codes, heights of superstructures (112, 122), inch counts, and/or other messages as noted above.

By way of example only, information in a selected vehicle profile may be used by lift system (100) to provide height limit stops (e.g., to ensure clearance between the highest part of the vehicle and the ceiling of the garage/shop room where it is located), to influence where adapters should be positioned along superstructures (112, 122), to determine expected axle engagement heights, etc. Vehicle profiles may also provide instructions for positioning post (124) and superstructure (122) at the appropriate location along longitudinal path (128) for a particular vehicle (or for a vehicle matching a particular profile). In some instances, axle engagement adapters on each superstructure (112, 122) are automated, such that the axle engagement adapters automatically move into the appropriate axle engaging position based on the selected vehicle profile. Such movement may be provided hydraulically, pneumatically, mechanically, electromechanically, and/or in any other suitable fashion. The operator may thus move all of the axle engagement adapters superstructures (112, 122) into position with a single key press through membrane switches (166). Various other ways in which a vehicle profile may be used to influence operation of lift system (100) will be apparent to those of ordinary skill in the art in view of the teachings herein.

It should be understood from the foregoing that the combination of membrane switches (166) and screen (164) provide interactive lift status and control from pendant control (150). In an exemplary use, the user may use membrane switches (166) and menu screen (164) on pendant control (150) to select the appropriate vehicle profile that matches with the vehicle that the user wishes to lift. Pendant control (150) may transmit the user's selection to control cabinet (130), which may command lift assembly (120) to position post (124) and superstructure (122) at the appropriate location along longitudinal path (128) for the selected vehicle profile. Control cabinet (130) may also command axle engagement adapters on each superstructure (112, 122) to move to the appropriate positions. The user may then use pendant control (150) to raise the vehicle. Data from the selected vehicle profile may continue to influence the operation of lift system (100), such as by restricting the permitted lift height, etc. Other suitable uses for first membrane switches (166) will be apparent to those of ordinary skill in the art in view of the teachings herein. It should also be understood that vehicle profiles and associated lift points may be updated in pendant control (150) as desired, using a laptop computer or other device.

In the present example, second membrane switches (168) comprise a set of three buttons arranged vertically. However it will be understood that any other suitable number and arrangement of buttons may be used. Second membrane switches (168) are operable to select a single particular lift assembly (110, 120) for controlling. For instance, if the user wishes to only operate one lift assembly (110, 120), the user may press just one switch (168). If the user wishes to operate two lift assemblies (110, 120), the user pay press a first switch (168) and a second switch (168). It will be understood that the number of second membrane switches (168) may correspond to the number of lift assemblies (110, 120) present. In some instances, however, the number of second membrane switches (168) may be greater or less than the number of lift assemblies (110, 120) present in vehicle lift system (100).

A plurality of lights (167) may run along second membrane switches (168). Each lights (167) may comprise an LED or any other suitable light source as will be apparent to one of ordinary skill in the art in view of the teachings herein. It will be understood that lights (167) may illuminate to indicate to the user which lift assemblies (110, 120) have been selected by switches (168) for operation. It will be appreciated that in some versions, lights (167) may be operable to illuminate in different colors or patterns to indicate to the user different statuses regarding superstructures associated with second membrane switches (168).

Mode switch (172) may be pressed by the user to toggle between different modes. In the present example, mode switch (172) toggles between a first mode and a second mode. In the first mode, pendant control (150) is operable to control vertical movement of posts (114, 124) and superstructures (112, 122) relative to inground portions (116, 126). In the second mode, pendant control (150) is operable to control horizontal movement of post (124) and superstructure (122) along longitudinal path (128). A vertical movement icon (170) is positioned above mode switch (172). Vertical height icon (170) comprises a graphical representation of a lift post and superstructure next to a vertically pointing double arrow. A horizontal movement icon (174) is positioned below mode switch (172). Horizontal movement icon (174) comprises a graphical representation of a lift post and superstructure next to a horizontally pointing double arrow. Icons (170, 174) comprise backlit cutouts formed in housing (152). The backlit feature of icons (170, 174) is achieved by LEDs or the like. Icons (170, 174) will illuminate based on the operator's mode selection through mode switch (172). In particular, when the operator selects the first mode, icon (170) illuminates. When the operator selects the second mode, icon (174) illuminates. As the operator repeatedly presses mode switch (172), the illumination of icons (170, 174) may toggle back and forth between icons (170, 174). It should be understood that icons (170, 174) may have any other suitable configurations.

Figure 7:
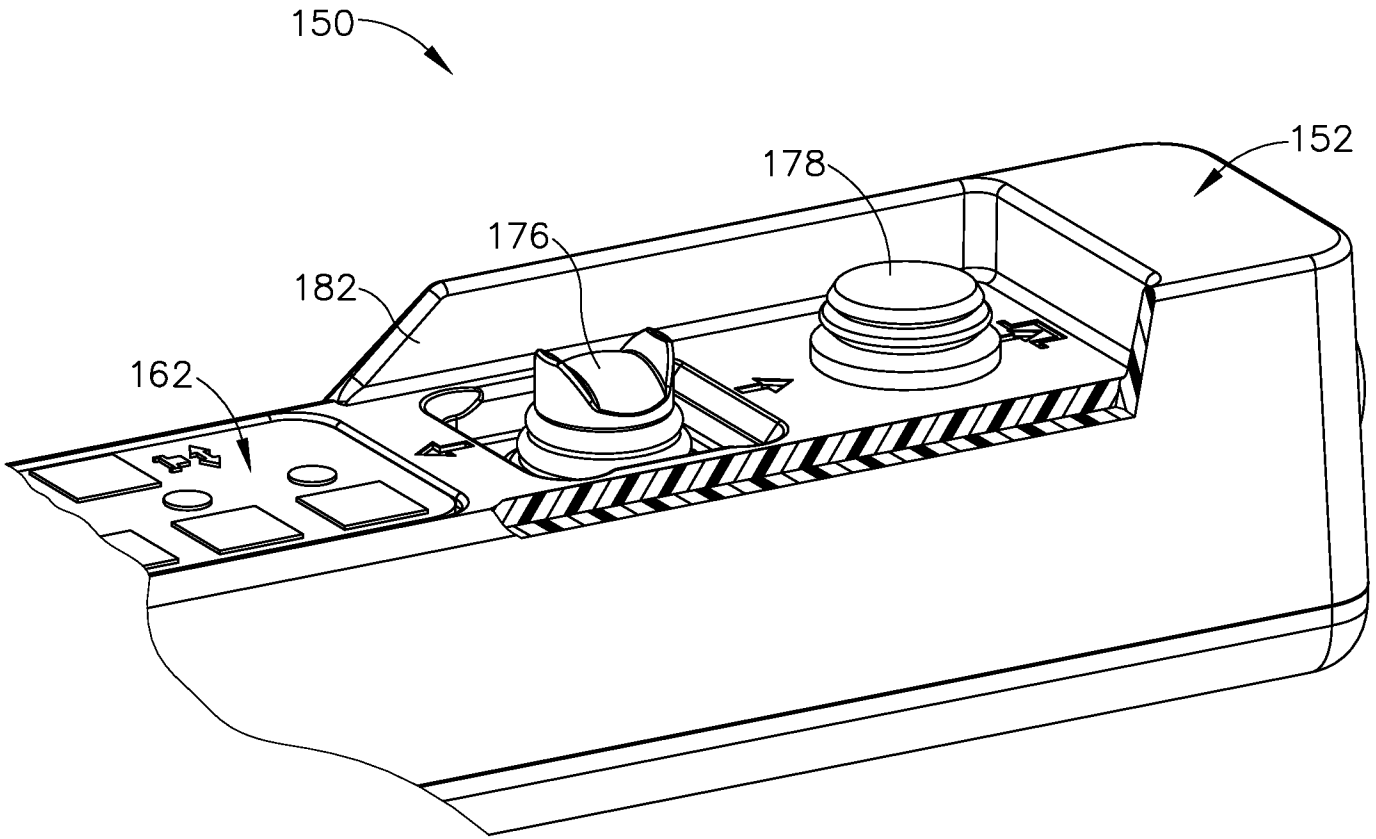
FIG. 7 depicts an enlarged, perspective cutaway view a lift rocker joystick and a lower to lock button of the pendant control of FIG. 2.

FIG. 7 depicts a cutaway view which shows lift rocker joystick (176) and lower to lock button (178). Lift rocker joystick (176) comprises a rocker switch, but any suitable switch type may be used as would be apparent to one of ordinary skill in the art in view of the teachings herein. Lift rocker joystick (176) is operable to control the movement of lift superstructures (110, 112). For instance, when the first mode of operation is selected, pressing the upper portion of rocker joystick (176) forward (e.g., toward lower lock button (178)) raises posts (114, 124) and superstructures (112, 122) relative to the ground; while pressing the lower portion of rocker joystick (176) backward (e.g., toward membrane panel (162)) lowers posts (114, 124) and superstructures (112, 122) relative to the ground. When the second mode of operation is selected, pressing the upper portion of rocker joystick (176) forward causes post (124) and superstructure (122) to translate along longitudinal path (128) in a direction away from lift assembly (110); while pressing the lower portion of rocker joystick (176) backward causes post (124) and superstructure (122) to translate along longitudinal path (128) in a direction toward lift assembly (110).

Lower to lock button (178) comprises a single, circular, pressable button, but it will be understood that any suitable button may be used as would be apparent to one of ordinary skill in the art in view of the teachings herein. Lower to lock button (178) is operable to instruct lift assemblies (110, 120) to lower posts (114, 124) and superstructures (112, 122) to a point where a mechanical lock feature is engaged in each lift assembly (110, 120), which may prevent further downward movement of posts (114, 124) and superstructures (112, 122) until the mechanical lock feature is disengaged. For instance, each lift assembly (110, 120) may have a mechanical lock feature that comprises a lock bar (190) and an engaging component (192) that is configured to engage the lock bar. Such mechanical lock features may permit posts (114, 124) and superstructures (112, 122) to ascend freely; while selectively restricting descent of posts (114, 124) and superstructures (112, 122). In particular, the mechanical lock features may prevent posts (114, 124) and superstructures (112, 122) from descending unless a lock release is activated (e.g., an activated lock release may prevent the engaging component from engaging the lock bar). During normal descent of posts (114, 124) and superstructures (112, 122), the lock releases may be activated to permit posts (114, 124) and superstructures (112, 122) to descend without being impeded by the lock features. When posts (114, 124) and superstructures (112, 122) are not in a normal descent mode (e.g., during an ascent mode), the lock releases may be de-activated, such that the lock features may prevent a posts (114, 124) and superstructures (112, 122) pair from falling to the ground in the event of a sudden pressure loss in the hydraulic system associated with post (114, 124). Of course, any other suitable kind of lock features may be used.

Housing (152) also includes raised ribs (182) that extend outwardly past rocker joystick (176) and lower to lock button (178) such that ribs (182) prevent inadvertent pressing of rocker joystick (176) and lower to lock button (178). It will be understood to other features may be used to shield rocker joystick (176) and lower to lock button (178). For instance, a pivotable cover or any other suitable structure may be used.

Figure 8:
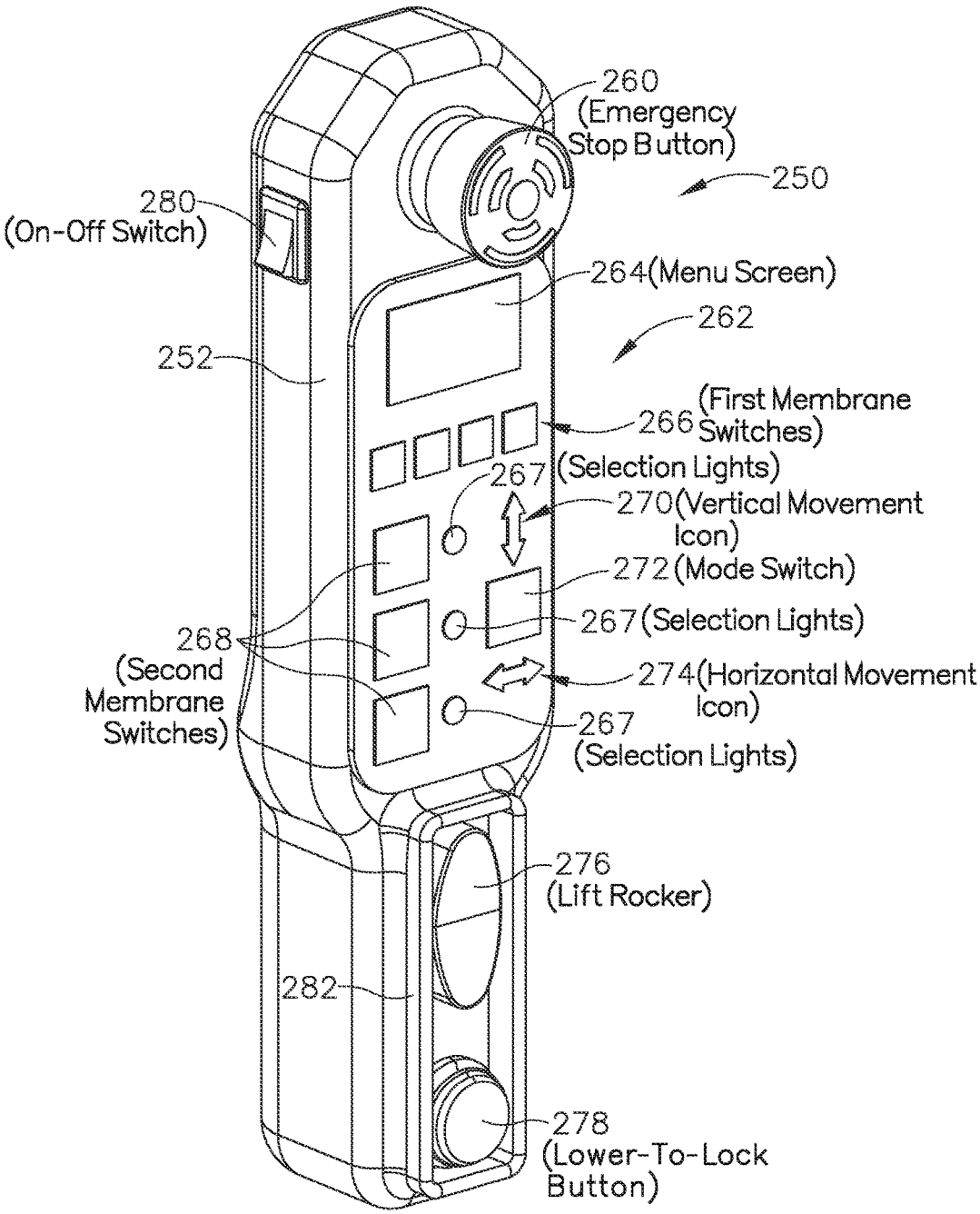
FIG. 8 depicts a front, perspective view of an exemplary alternative pendant control.
Figure 9:
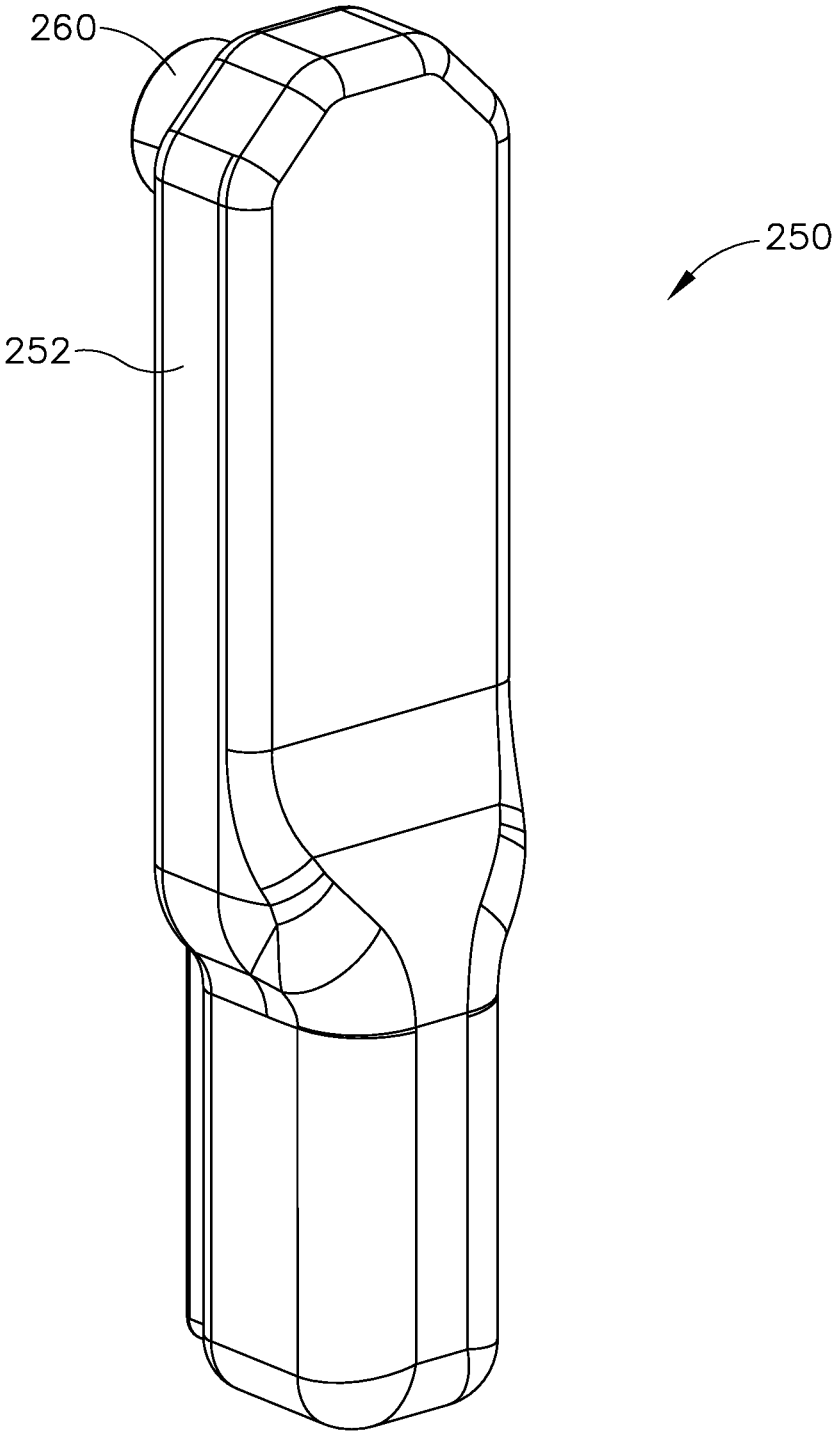
FIG. 9 depicts a rear, perspective view the pendant control of FIG. 8.
Figure 10:
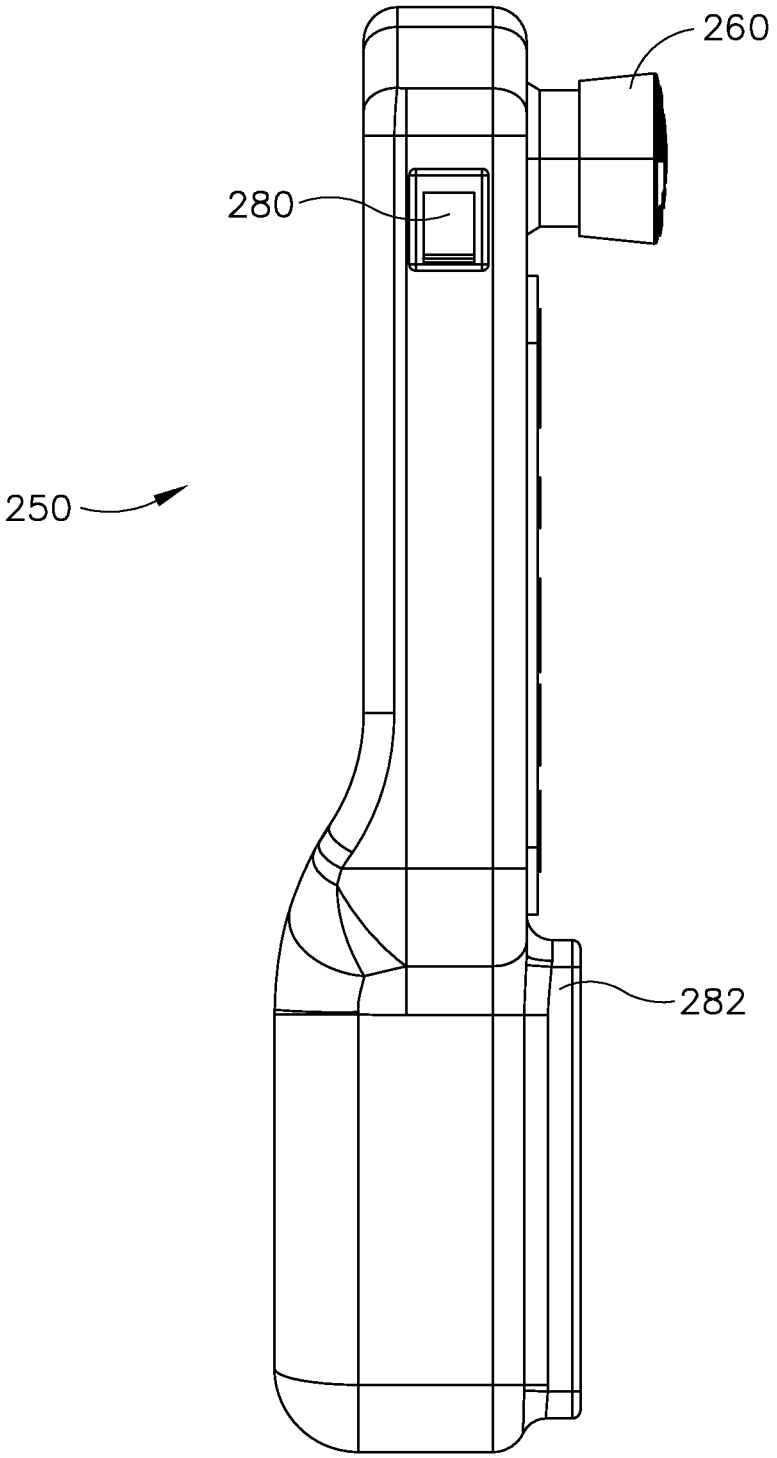
FIG. 10 depicts a side, elevational view of the pendant control of FIG. 8.

FIGS. 8-10 depict an exemplary alternative pendant control (250) comprising a housing (252), emergency stop button (260), membrane panel (262), menu screen (264), mode switch (272), upper LED cutouts (270), lower LED cutouts (274), first membrane switches (266), second membrane switches (268), plurality of lights (267), ribbed portion (282), lift rocker (276), lower to lock button (278), and on-off switch (280). It will be appreciated that emergency stop button (260), membrane panel (262), mode switch (272), upper LED cutouts (270), lower LED cutouts (274), first membrane switches (266), second membrane switches (268), plurality of lights (267), lift rocker (276), and lower to lock button (278) are substantially similar to emergency stop (160), membrane panel (162), mode switch (172), vertical movement icon (170), horizontal movement icon (174), first membrane switches (166), second membrane switches (168), plurality of lights (167), lift rocker joystick (176), lower to lock button (178), and on-off switch (180), respectively, described above. Some of the differences between pendant control (250) and pendant control (150) will be discussed below.

Alternative pendant (250) is shown as having a different configuration of first membrane switches (266). In particular, pendant (250) is shown as having four membrane switches (266) as opposed to three membrane switches (266). It will be appreciated that first membrane switches (266) may be used to navigate menus displayed on menu screen (264). For instance, "up" and "down" may be used to cycle through menu options. "Enter" may be used to select/confirm a menu option. "Cancel" may be used to cancel an option. As described above, it should be understood that any suitable controls may be used for first membrane switches (266) as would be apparent to one of ordinary skill in the art in view of the teachings herein.

On-off switch (280) is positioned on the side of pendant (250). On-off switch (280) is operable to turn pendant (250) on or off. It will be understood that while the exemplary version shows a switchable rocker for on-off switch (280), other suitable switches may be used as would be apparent to one of ordinary skill in the art in view of the teachings herein. In other versions, such as pendant (150), above, on-off switch (280) may be omitted entirely.

Housing (252) of pendant (250) has a different shape than housing (152) of pendant (150). In particular, housing (252) is shaped to be flatter with rounded and beveled corners. Furthermore, housing (252) is shaped such that the upper portion of housing (252) is wider than the bottom portion. It will be understood that any suitable shape for housing (252) may be used as would be apparent to one of ordinary skill in the art in view of the teachings herein. Menu screen (264) of pendant comprises a single LCD screen operable to display information to the user. As mentioned above, menu screen (264) may be constructed of a single display but may also be configured to be a multi-part display as seen in FIG. 2. Rib (282) of pendant (250) comprises a raised, rounded, rectangular perimeter operable to encircle rocker (276) and lower to lock button (278). Of course, rib (282) may have any other suitable configuration.

It should be understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A method for operating a vehicle lift, the method comprising the steps of:

(a) selecting a vehicle profile from a list of a plurality of vehicle profiles from a control system, wherein the control system is in communication with a plurality of lift assemblies, wherein at least one of the lift assemblies has at least two dimensions of movement; and (b) engaging a movement initiation switch, wherein the control system automatically controls the starting, stopping, and direction of movement of each of the lift assemblies in the plurality of lift assemblies to achieve a one-touch movement of the assemblies according to the parameters of the selected vehicle profile, including movement of the at least one of the lift assemblies in both of its two dimensions of movement, in response to the act of engaging the movement initiation switch.

2. The method of claim 1, wherein the plurality of lift assemblies comprise a two-post in-ground lift.

3. The method of claim 1, wherein the plurality of lift assemblies comprise an above-ground lift.

4. The method of claim 1, wherein the plurality of lift assemblies comprises an in-ground scissor lift.

5. The method of claim 1, wherein selecting the vehicle profile comprises scrolling through the list of the plurality of vehicle profiles and then selecting the vehicle profile.

6. The method of claim 1, wherein the control system comprises a pendant control.

7. The method of claim 6, wherein the pendant control comprises a plurality of switches and a menu screen, and the movement initiation switch is one of the plurality of switches.

8. A method for operating a vehicle lift, the method comprising the steps of:

(a) selecting a vehicle profile from a plurality of vehicle profiles from a control system, wherein the control system is in communication with a plurality of lift assemblies, and at least one of the lift assemblies has at least two dimensions of movement;

(b) triggering movement initiation through the control system; and (c) in response to the step of triggering movement initiation, the control system automatically controls the starting, stopping, and direction of movement of each of the lift assemblies in the plurality of lift assemblies to achieve a one-touch movement of the assemblies according to information in the selected vehicle profile, including movement of the at least one of the lift assemblies in both of its two dimensions of movement.

9. The method of claim 8, wherein the plurality of lift assemblies comprise a two-post in-ground lift.

10. The method of claim 8, wherein the plurality of lift assemblies comprise an above-ground lift.

11. The method of claim 8, wherein the plurality of lift assemblies comprises an in-ground scissor lift.

12. The method of claim 8, wherein selecting the vehicle profile comprises scrolling through the list of the plurality of vehicle profiles and then selecting the vehicle profile.

13. The method of claim 8, wherein the control system comprises a pendant control.

14. The method of claim 13, wherein the pendant control comprises a plurality of switches and a menu screen, and the triggering movement initiation step is performed using at least one of the plurality of switches.

* * * * *